US005997061A

United States Patent [19]

Langley

[11] Patent Number: 5,997,061

[45] Date of Patent: Dec. 7, 1999

[54] BAG HOLDER

[76] Inventor: Burton Langley, 1752 St Tropez Ct., Kissimmee, Fla. 34744

[21] Appl. No.: 09/094,857

[22] Filed: Jun. 15, 1998

[51] Int. Cl.[6] ..... B65B 67/12; B65F 1/00

[52] U.S. Cl. ..... 294/1.1; 248/101

[58] Field of Search ..... 294/1.1, 1.3–1.5, 294/55; 141/108, 391; 248/97, 99–101; 15/257.1, 257.3, 257.7, 257.9

[56] References Cited

U.S. PATENT DOCUMENTS

| | | | |
|---|---|---|---|
| 1,266,522 | 5/1918 | Oldham | 294/1.1 |
| 1,455,536 | 5/1923 | Lebherz | 248/100 |
| 3,942,832 | 3/1976 | Haas, Jr. . | |
| 4,440,430 | 4/1984 | Kruse | 294/55 |
| 4,457,549 | 7/1984 | Lowery | 294/1.4 |
| 4,723,803 | 2/1988 | Sapp | 294/1.1 |
| 5,031,948 | 7/1991 | Groth et al. | 294/1.1 |
| 5,413,394 | 5/1995 | Mitchell | 294/1.1 |

*Primary Examiner*—Dean J. Kramer
*Attorney, Agent, or Firm*—Donald A. Kettlestrings

[57] ABSTRACT

A bag holder for facilitating placement of leaves, trash, laundry or the like into the open mouth of the bag includes a circular or oval-shaped frame having first and second supports connected to the frame and having first and second bag fastening members connected to the supports. The frame defines first and second bag-receiving notches, and the fastening members and notches are positioned at four corners of an imaginary rectangle or trapezoid. A handle is connected to the frame, and a clamp and stop are connected to the handle. A bag mouth can be placed over the circular or oval frame and pulled tightly around the rectangle or trapezoid formed by the fastening members and notches with an excess, gathered portion of the bag held between the clamp and stop so that the bag mouth is held open in a substantially rectangular or trapezoidal configuration for easy access to the interior of the bag.

11 Claims, 3 Drawing Sheets

BAG HOLDER

BACKGROUND OF THE INVENTION

This invention relates to a bag holder and more particularly to a holder for a bag for facilitating placement of trash, leaves, laundry or the like into the open mouth of the bag.

Use of plastic or paper bags for collecting trash or leaves can be a difficult and frustrating task because the mouth of the bag is difficult to hold open while carrying the bag and while attempting to insert trash or leaves into the mouth of the bag. The process can be a particularly difficult one when the wind is blowing because the bag mouth is often closed or twisted. A similar problem exists when plastic, cloth or mesh bags are used as laundry bags.

It is, therefore, an object of the present invention to provide a holder for a bag for facilitating placement of trash, leaves, laundry or the like into the open mouth of the bag.

Another object is to provide such a bag holder which can be easily carried by the user during use.

A further object of the invention is the provision of such a bag holder which is easy and convenient to use.

Still another object is to provide a holder for bags which is inexpensive to manufacture.

A further object is to provide such a holder for bags which can be carried and used by prisoners, contractors and other workers while cleaning highways, parks and other public areas of trash.

Another object is to provide such a bag holder which can be easily stored or transported when not in use.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides a holder for a bag for facilitating placement of trash, leaves, laundry or the like into the mouth of the bag, the holder comprising: a substantially circular or oval-shaped frame defining a first upper surface; first and second supports connected to the frame; first and second bag fastening members connected to the first and second supports, respectively; first and second bag-receiving means in operative relationship with the frame for receiving first and second portions of the bag therein, the bag-receiving means and the fastening members positioned at four corners, respectively, of an imaginary rectangle or trapezoid; a third support in operative relationship for supporting the frame; and means in operative relationship with the frame for holding a third portion of the bag while the bag is simultaneously positioned on the first upper surface, held by the fastening members and positioned within the bag-receiving means, whereby the bag mouth is held open in a substantially rectangular or trapezoidal configuration for easy access to the interior of the bag.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
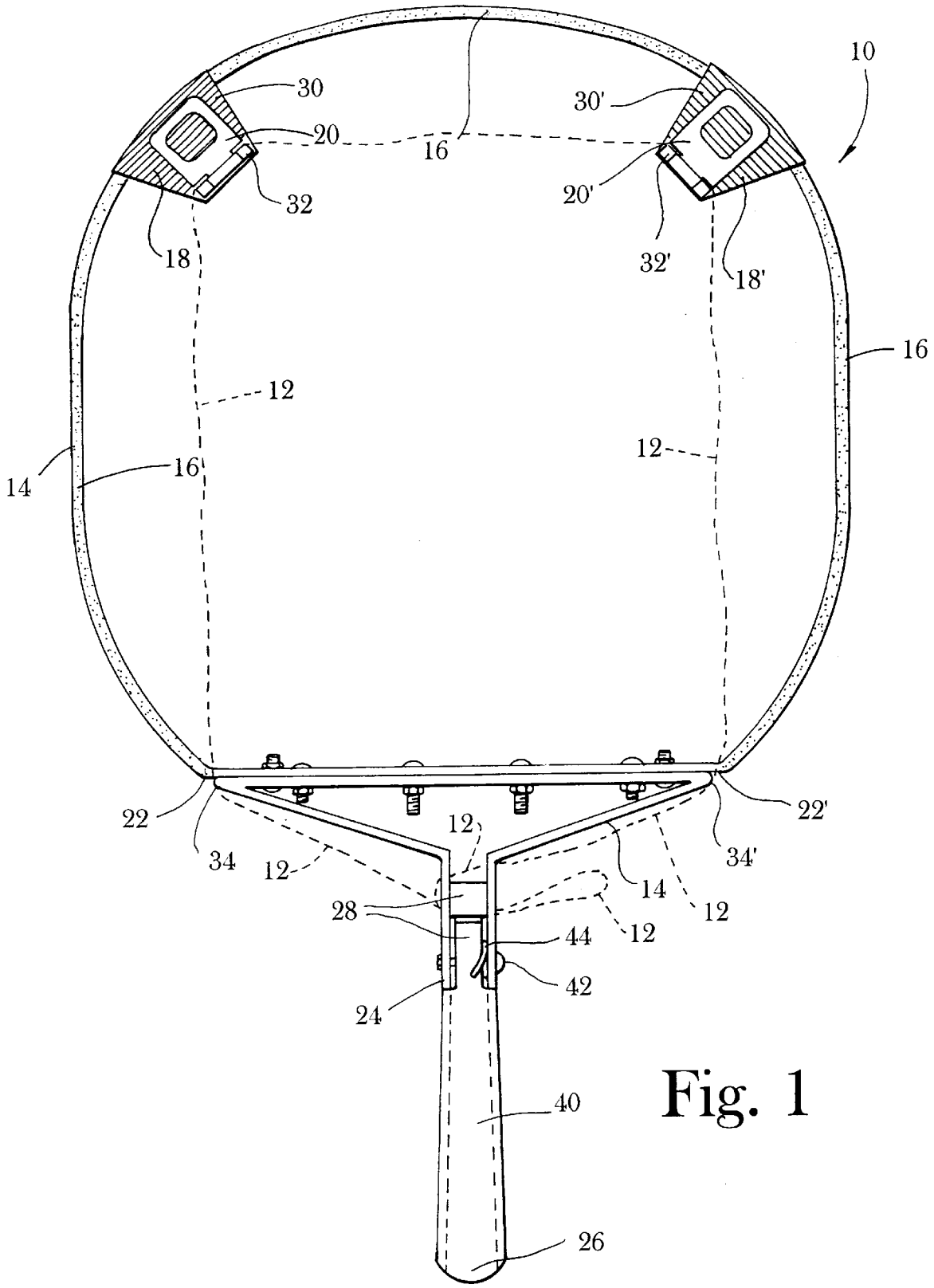
FIG. 1 is a top plan view of the bag holder.
Figure 2:
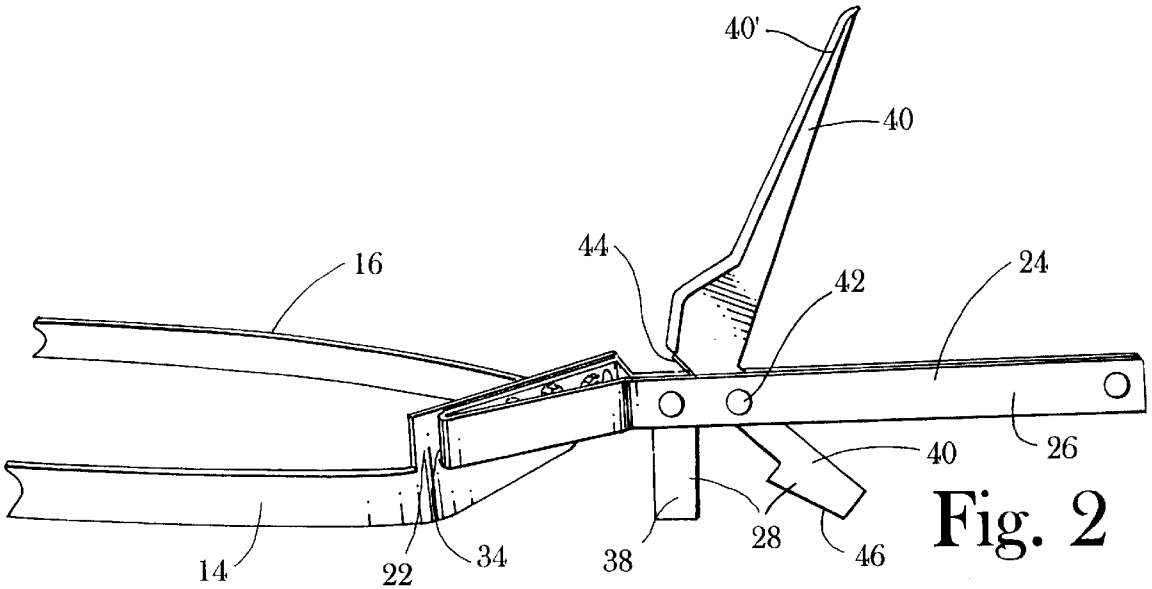
FIG. 2 is a fragmentary perspective view of the bag holder showing the bag clamp member in an open or raised position.
Figure 3:
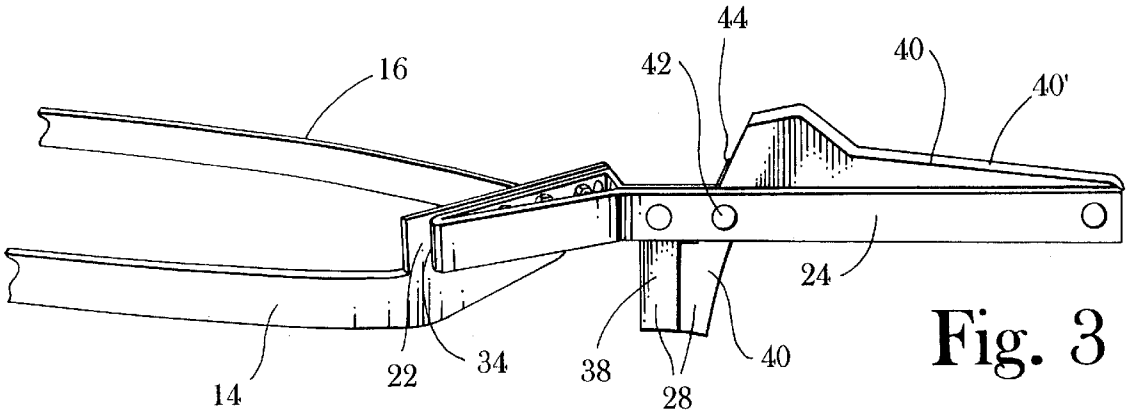
FIG. 3 is a fragmentary perspective view of the bag holder showing the bag clamp member in a closed position against the stop member.
Figure 4:
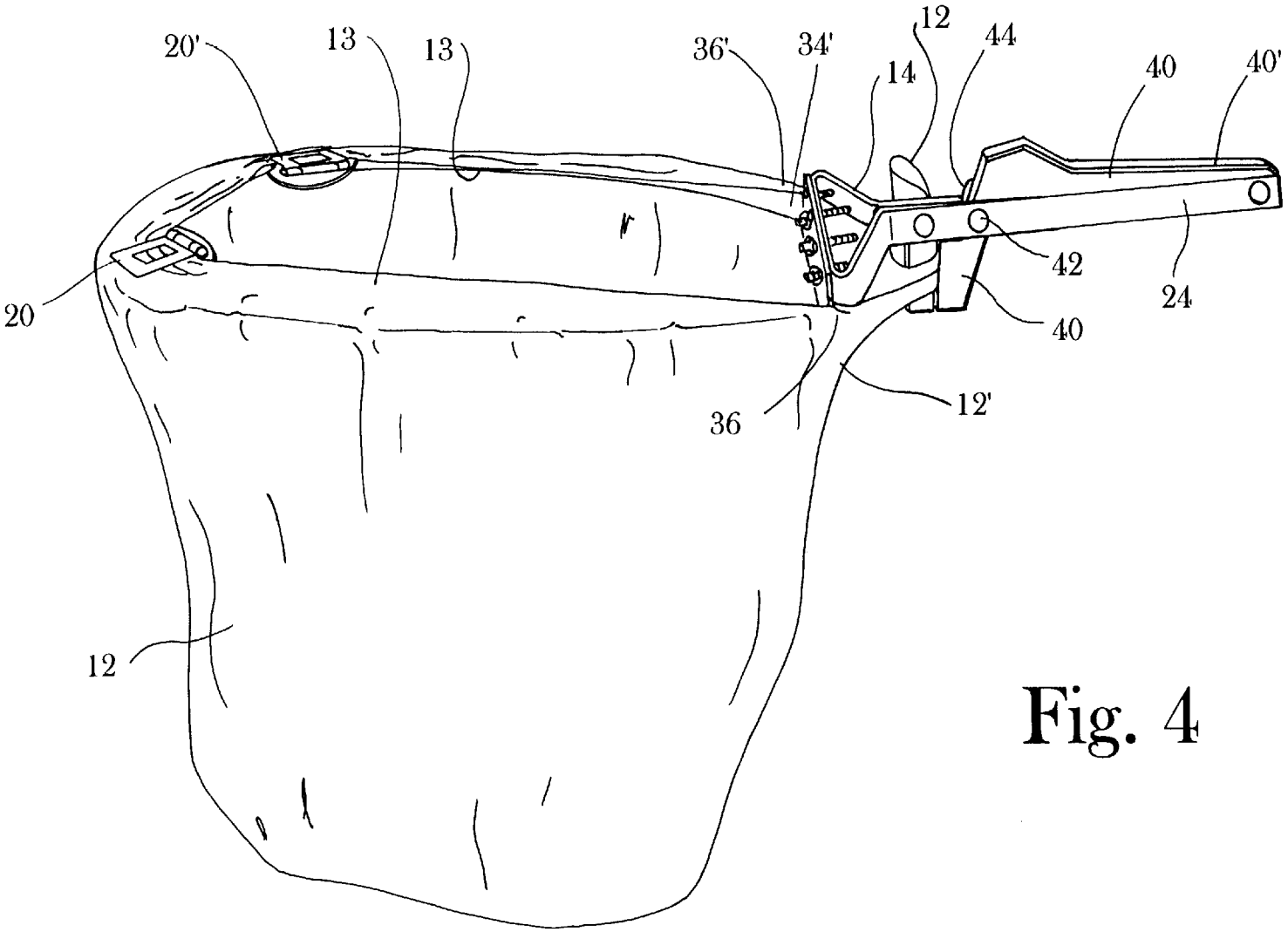
FIG. 4 is a perspective view of the bag holder showing a bag held by the bag holder.

With reference now to the drawings, wherein like reference characters designate like or corresponding parts throughout the several views, there is shown a holder 10 for a plastic, cloth, paper or mesh bag 12.

In accordance with the invention, holder 10 preferably comprises a substantially circular frame 14 defining a first upper surface 16. First and second supports, 18, 18' project inwardly from and are connected in a conventional manner to frame 14. First and second bag fastening members 20, 20' are connected to and mounted on supports 18, 18', respectively, in a conventional manner. Frame 14 can also be an oval shape.

First and second bag-receiving means 22, 22' are provided in operative relationship with frame 14 for receiving first and second portions, respectively, of bag 12 therein. Bag-receiving means 22, 22' and fastening elements 20, 20' are positioned at four corners, respectively, of an imaginary rectangle or trapezoid.

A third support 24 is provided in operative relationship for supporting frame 14. Support 24 preferably includes a handle 26, but support 24 may also be a support stand (not shown) for supporting frame 14 in a fixed location.

Holder 10 further comprises means 28 in operative relationship with frame 14 for holding an excess, gathered portion 12' of bag 12 while the bag is simultaneously positioned on first upper surface 16, held by fastening members 20, 20' and positioned within bag-receiving means 22, 22', whereby bag mouth 13 is held open in a substantially rectangular or trapezoidal configuration for providing easy access to the interior of the bag.

First upper surface 16 preferably defines a roughened, irregular surface for inhibiting movement or slippage of bag 12 along surface 16 when bag 12 is positioned on holder 10.

Supports 18, 18' define first and second upper support surfaces 30, 30', respectively, and surfaces 30, 30' are preferably irregular or grooved surfaces for inhibiting movement or slippage of bag 12 along surfaces 30, 30' when bag 12 is held in place between fastening members 20, 20' and support surfaces 30, 30', respectively.

Bag fastening members 20, 20' are preferably each spring-biased members which are conventionally biased by springs 32, 32', respectively, toward normally closed positions against upper support surfaces 30, 30', respectively. This enables a user to insert bag 12 between spring-biased members 20, 20' and upper support surfaces 30, 30', respectively, to be held in place thereby, after release of bag 12 and after release of spring-biased members 20, 20' by the user.

Bag-receiving means 22, 22' preferably include first and second notches 34, 34', respectively, defined by frame 14 for receiving portions 36, 36' of bag 12 therein.

In accordance with the invention, holding means 28 preferably include a stop member 38 connected to handle 26, and a clamp member 40 rotatably mounted on handle 26 by pin 42. Clamp member 40 is positioned adjacent to stop member 38 for enabling excess portion 12' of bag 12 to be gathered and held between clamp member 40 and stop member 38 while bag 12 is simultaneously positioned on first upper surface 16, held by fastening members 20, 20' and positioned within notches 34, 34'. This positioning of bag 12 results in bag mouth 13 being held open in a substantially rectangular or trapezoidal configuration for easy access to the interior of bag 12 by the user.

Clamp member 40 is preferably a spring-biased clamp member which is biased by clamp member spring 44 toward a normally closed position against stop member 38 for enabling a user to insert excess, gathered portion 12' of bag 12 between spring-biased clamp member 40 and stop member 38 to be held in place thereby after release of bag 12 and after release of spring-biased clamp member 40 by the user. Spring 44 can be mounted around and connected to pin 42 and positioned in a conventional manner against clamp member 40 to bias clamp member 44 toward a normally closed position against stop member 38.

Clamp member 40 preferably defines an irregular surface portion 46 for engaging and holding bag 12 in cooperation with stop member 38, and irregular surface 46 preferably defines a grooved surface.

In operation and use, bag mouth 13 of bag 12 is positioned over frame 14 and onto upper surface 16. Mouth 13 is formed into and held open in a substantially rectangular or trapezoidal configuration by positioning portions of bag 12 onto support surfaces 30, 30' and by holding those portions of bag 12 in position on supports 18, 18' by means of spring-biased fastening members 20, 20'.

Mouth 13 of bag 12 is then pulled tightly, and portions of bag 12 are positioned within notches 34, 34'. An excess portion 12' of bag 12 is then gathered and pulled into place to be held between spring-biased clamp member 40 and stop member 38. Bag 12 is, thus, draped over frame 14 with mouth 13 of the bag tightly formed into a substantially rectangular or trapezoidal configuration at corners formed by fastening members 20, 20' and by notches 34, 34'. Excess portion 12' of the bag is tightly pulled between clamp member 40 and stop member 38 so that bag 12 is firmly held in position on holder 10. Spring-biased fastening members 20, 20' and spring-biased clamp member 40 act to hold bag 12 in position on frame 14.

The user can then grasp handle 26 with one hand and can carry bag 12 and holder 10 while retrieving and inserting leaves, trash, laundry or the like into open mouth 13 of the bag. By use of holder 10, mouth 13 of the bag is held open so that the user does not need to continuously try to position mouth 13 of the bag so that it is in an open position.

When bag 12 is filled or when use of the bag is completed, bag 12 can be quickly and easily removed from holder 10 by moving clamp member 40 to an open position to release excess gathered portion 12' of the bag. Mouth portion 13 of bag 12 can then be quickly and easily removed from notches 34, 341 and from fastening members 20, 20' by moving spring-biased fastening members 20, 20' to open positions.

Holder 10 is preferably made from metal or plastic, and holder 10 can be easily stored or transported when not in use.

Clamp member 40 may not be spring-biased. In this embodiment (not shown), the user will grasp handle 26 and portion 40' of clamp member 40 simultaneously so that clamp member 40 will cooperate with stop member 38 to hold excess, gathered portion 12' of the bag in position between clamp member 40 and stop member 38, without the use of a spring to normally bias clamp member 40 in a closed position toward stop member 38.

This invention provides for an inexpensive and convenient holder for facilitating placement of leaves, trash, laundry or the like into the open mouth of the bag.

The invention in its broader aspects is not limited to the specific details shown and described, and departures may be made from such details without departing from the principles of the invention and without sacrificing its chief advantages.

What is claimed is:

1. A holder for a bag for facilitating placement of leaves, trash, laundry or the like into the mouth of the bag, said holder comprising:

a substantially circular frame defining a first upper surface;

first and second supports connected to said frame;

first and second bag fastening members connected to said first and second supports, respectively;

first and second bag-receiving means in operative relationship with said frame for receiving first and second portions of said bag therein, said bag-receiving means and said fastening members positioned at four corners, respectively, of an imaginary rectangle or trapezoid;

a third support in operative relationship for supporting said frame;

means in operative relationship with said frame for holding a third portion of said bag while said bag is simultaneously positioned on said first upper surface, held by said fastening members and positioned within said bag-receiving means, whereby the bag mouth is held open in a substantially rectangular or trapezoidal configuration for easy access to the interior of the bag; and wherein said first upper surface defines a roughened, irregular surface for inhibiting the bag from slipping along said upper surface.

2. A holder for a bag for facilitating placement of leaves, trash, laundry or the like into the mouth of the bag, said holder comprising:

a substantially circular frame defining a first upper surface;

first and second supports connected to said frame;

first and second bag fastening members connected to said first and second supports, respectively;

first and second bag-receiving means in operative relationship with said frame for receiving first and second portions of said bag therein, said bag-receiving means and said fastening members positioned at four corners, respectively, of an imaginary rectangle or trapezoid;

a third support in operative relationship for supporting said frame;

means in operative relationship with said frame for holding a third portion of said bag while said bag is simultaneously positioned on said first upper surface, held by said fastening members and positioned within said bag-receiving means, whereby the bag mouth is held open in a substantially rectangular or trapezoidal configuration for easy access to the interior of the bag; and wherein said first and second supports define first and second upper support surfaces, respectively, defining irregular surfaces for inhibiting the bag from slipping along said first and second support surfaces.

3. A holder for a bag for facilitating placement of leaves, trash, laundry or the like into the mouth of the bag, said holder comprising:

a substantially circular frame defining a first upper surface;

first and second supports connected to said frame;

first and second bag fastening members connected to said first and second supports, respectively;

first and second bag-receiving means in operative relationship with said frame for receiving first and second portions of said bag therein, said bag-receiving means and said fastening members positioned at four corners, respectively, of an imaginary rectangle or trapezoid;

a third support in operative relationship for supporting said frame;

means in operative relationship with said frame for holding a third portion of said bag while said bag is simultaneously positioned on said first upper surface, held by said fastening members and positioned within said bag-receiving means, whereby the bag mouth is held open in a substantially rectangular or trapezoidal configuration for easy access to the interior of the bag; and wherein said first and second supports define first and second upper support surfaces and wherein said first and second bag fastening members are each spring-biased members which are biased toward normally closed positions against said first and second upper support surfaces for enabling a user to insert said bag between said first and second spring-biased members and said first and second upper support surfaces, respectively, to be held in place thereby after release of said bag and said spring-biased members by said user.

4. A holder as in claim 3 wherein said first and second bag-receiving means include first and second notches, respectively, defined by said frame for receiving said first and second portions of said bag therein.

5. A holder as in claim 4 wherein said third support includes a handle connected to said frame for grasping, holding and carrying said holder by a user.

6. A holder as in claim 5 wherein said holding means include:

a stop member connected to said handle; and a clamp member rotatably mounted on said handle and positioned adjacent to said stop member for enabling said third portion of said bag to be held between said clamp member and said stop member while said bag is simultaneously positioned on said first upper surface, held by said fastening members and positioned within said notches, whereby the bag mouth is held open in a substantially rectangular configuration for easy access to the interior of the bag.

7. A holder as in claim 6 wherein said clamp member is a spring-biased clamp member which is biased toward a normally closed position against said stop member for enabling a user to insert said third portion of said bag between said spring-biased clamp member and said stop member to be held in place thereby after release of said bag and said spring-biased clamp member by said user.

8. A holder as in claim 7 wherein said third portion of said bag is a gathered portion of said bag.

9. A holder as in claim 8 wherein said clamp member defines an irregular surface portion for engaging and holding said bag in cooperation with said stop member.

10. A holder as in claim 9 wherein said irregular surface portion of said clamp member defines a grooved surface.

11. A method of holding a bag for facilitating placement of leaves, trash, laundry or the like into the mouth of the bag by use of a bag holder having a substantially circular frame, said method comprising the steps of:

positioning and holding the mouth of said bag in a substantially rectangular or trapezoidal configuration on said bag holder;

pulling said bag tightly over said frame;

gathering an excess portion of said bag; and holding said excess portion of said bag in fixed position with respect to said bag holder.

* * * * *